US008282752B2

(12) United States Patent
Rancourt

(10) Patent No.: US 8,282,752 B2
(45) Date of Patent: Oct. 9, 2012

(54) MOBILE DELIVERY PLATFORM FOR FLOWABLE EXPLOSIVE

(75) Inventor: Marc Rancourt, Watkins, CO (US)

(73) Assignee: Orica Explosives Technology Pty Ltd, Melbourne (AU)

( * ) Notice: Subject to any disclaimer, the term of this patent is extended or adjusted under 35 U.S.C. 154(b) by 228 days.

(21) Appl. No.: 12/864,066

(22) PCT Filed: Jan. 23, 2009

(86) PCT No.: PCT/AU2009/000074

§ 371 (c)(1),
(2), (4) Date: Aug. 24, 2010

(87) PCT Pub. No.: WO2009/092137

PCT Pub. Date: Jul. 30, 2009

(65) Prior Publication Data

US 2010/0327011 A1 Dec. 30, 2010

Related U.S. Application Data

(60) Provisional application No. 61/022,902, filed on Jan. 23, 2008.

(51) Int. Cl.
*D03D 23/00* (2006.01)
*C06B 21/00* (2006.01)

(52) U.S. Cl. ..... 149/109.6; 86/1.1; 86/20.15

(58) Field of Classification Search ..... 149/109.6; 86/1.1, 20.15
See application file for complete search history.

(56) References Cited

U.S. PATENT DOCUMENTS

| | | | | |
|---|---|---|---|---|
| 3,380,333 | A | 4/1968 | Clay et al. | |
| 3,848,507 | A * | 11/1974 | Wisinski | 86/1.1 |
| 4,195,548 | A | 4/1980 | Cook et al. | |
| 4,508,035 | A * | 4/1985 | Mashimo et al. | 102/313 |
| 4,526,633 | A | 7/1985 | Lawrence et al. | |
| 4,966,077 | A * | 10/1990 | Halliday et al. | 102/313 |
| 5,811,711 | A | 9/1998 | Tremblay et al. | |

FOREIGN PATENT DOCUMENTS

WO WO 02/29353 A1 4/2002

OTHER PUBLICATIONS

International Search Report, dated Mar. 17, 2009, issued in corresponding international application PCT/AU2009/000074.

* cited by examiner

*Primary Examiner* — Aileen B Felton
(74) *Attorney, Agent, or Firm* — Birch, Stewart, Kolasch & Birch, LLP.

(57) ABSTRACT

Apparatus for storing and dispensing flowable explosive, the apparatus including an explosive pump for pumping flowable explosive into an explosive tank having a fluid pressure-actuated piston movable therein for expelling flowable explosive out of the explosive tank through a delivery hose fitted with an injector through which one or more additives from one or more additive tanks can be pumped by an additive pump.

10 Claims, 2 Drawing Sheets

MOBILE DELIVERY PLATFORM FOR FLOWABLE EXPLOSIVE

CROSS REFERENCE TO RELATED APPLICATIONS

This application is the National Phase of PCT/AU2009/000074 filed on Jan. 23, 2009, which claims priority under 35 U.S.C. 119(e) to U.S. Provisional Application No. 61/022,902 filed on Jan. 23, 2008. The entire contents of all the above applications are hereby incorporated by reference.

FIELD OF THE INVENTION

The present invention relates to a mobile delivery platform for flowable explosive.

BACKGROUND OF THE INVENTION

Flowable explosive, such as emulsion explosive, is conventionally delivered in surface and underground applications using gravity tanks. Gravity tanks have a high centre of gravity and are not easily transportable. They also require a top access structure for cleaning and maintenance of the inside walls to prevent crystallization of the emulsion explosive. The top access structure limits tank capacity and is a fall hazard for workers.

A need therefore exists for a mobile, self-cleaning delivery platform for flowable explosive.

SUMMARY OF THE INVENTION

According to the present invention, there is provided apparatus for storing and dispensing flowable explosive, the apparatus including an explosive pump for pumping flowable explosive into an explosive tank having a fluid pressure-actuated piston movable therein for expelling flowable explosive out of the explosive tank through a delivery hose fitted with an injector through which one or more additives from one or more additive tanks can be pumped by an additive pump.

The explosive tank and the piston therein can be cylindrical with a common horizontal longitudinal axis.

The piston can have one or more circumferential seals for cleaningly wiping the inner surface of the explosive tank.

The piston can be a concave piston that is radially expandable to sealingly engage the inner surface of the explosive tank.

The explosive tank can have a detector therein for detecting displacement of the piston and/or monitoring quantities of flowable explosive in the explosive tank.

The one or more additives can be lubricant stored in a lubricant tank, and explosive additive stored in an explosive additive tank.

The delivery hose can be wound on a hose reel.

The tanks, pumps, and hose reel can be arranged on a transportable platform.

The flowable explosive can be selected from emulsion explosive, gel explosive, slurry explosive, blended explosive, and doped explosive.

The present invention also provides a method of delivering flowable explosive using the above apparatus.

BRIEF DESCRIPTION OF THE DRAWINGS

The invention will be further described by way of example only with reference to the accompanying drawings, in which.

DETAILED DESCRIPTION

Figure 1:
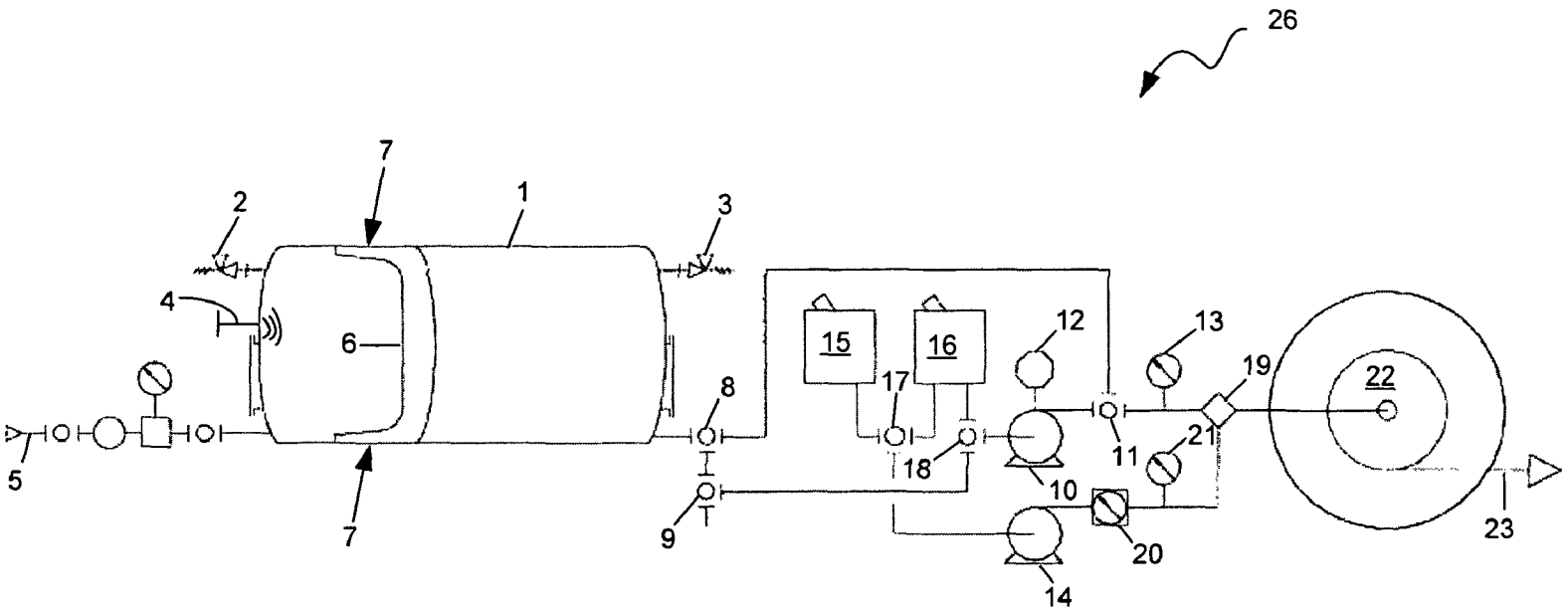
FIG. 1 is a schematic diagram of fluid circuit of an embodiment of a mobile delivery platform for flowable explosive of the invention.
Figure 2:
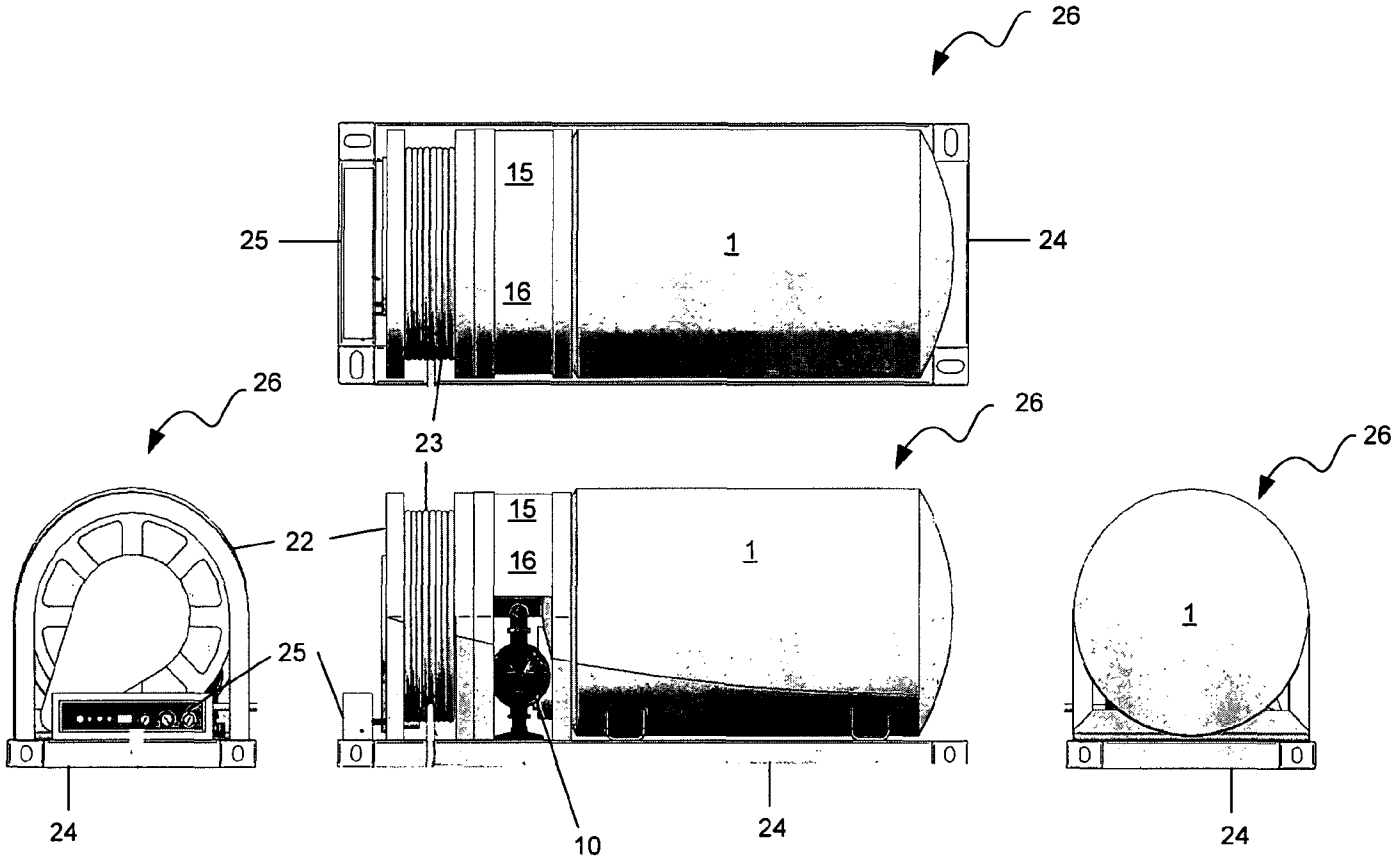
FIG. 2 are side, plan and end view of the mobile delivery platform.

Referring to the FIG. 1, an embodiment of a mobile delivery platform 26 for flowable explosive generally includes an explosive tank 1, an explosive pump 10, an additive pump 14, an explosive additive tank 15, a lubricant tank 16, and a delivery hose 23 wound on a hose reel 22. Referring to FIG. 2, these components are arranged together on a transportable platform 24, for example, a multimodal transport platform with International Standards Organization (ISO) standardised multimodal attachments or fittings.

The explosive tank 1 is cylindrical and is made, for example, of a corrosion resistant or a suitable pressure vessel material. The explosive tank 1 has a capacity, for example, of 3 tonne. A cylindrical piston 6 is axially movable inside the explosive tank 1. The explosive tank 1 and piston 6 have a common longitudinal axis horizontal to the transportable platform 24. The piston 6 is a concave piston that is radially expandable when pressurised to sealingly engage the inner surface of the explosive tank 6. Two circumferential seals 7 are provided on the piston 6. The piston seals 7 cleaningly wipe the inner surface of the explosive tank 1 during axial movement therein of the piston 6. Together, the piston 6 and the piston seals 7 provide a "self-cleaning" action that prevents build-up of flowable explosive on the inner surface of the explosive tank 1. Other equivalent "self-cleaning" piston and seal arrangements may also be used. The piston 6 is made of, for example, corrosion resistant material. The piston seals 7 and the delivery hose 23 are made of, for example, rubber. Together, the piston 6 and piston seals 7 sealingly divide the explosive tank 1 into opposed pressure and explosive ends.

The pressure end of the explosive tank 1 is provided with an inlet manifold 5, a pressure relief valve 2, and a piston displacement sensor 4. The pressure inlet manifold 5 includes a pressure regulator and a pressure gauge. The piston displacement sensor 4 is, for example, a laser detector.

The explosive end of the explosive tank 1 is provided with a pressure relief valve 3 and a selector valve 8 to control flow of flowable explosive to and from an inlet/outlet port in the explosive tank 1. The flowable explosive is, for example, emulsion explosive, gel explosive, slurry explosive, blended explosive, doped explosive, etc. The flowable explosive has a viscosity of between around 20,000 and 90,000 centipoise (cP), for example, 40,000 cP.

Flowable explosive is drawn from an external supply (not shown) via selector valves 9, 18 by the explosive pump 10 and pumped via selector valves 11, 8 into the explosive end of the explosive tank 1. This displaces the piston 6 backwardly toward the pressure end of the explosive tank 1. The backward displacement of the piston 6 is monitored by the piston displacement sensor 4. The pressure relief valve 2 acts as a bleed valve to maintain backpressure against the piston 6 so that it is positively retained next to flowable explosive pumped into the explosive tank 1. A flow meter 12 is connected to the explosive pump 10 to indicate the flow rate of flowable explosive pumped into the explosive tank 1. The explosive pump 10 is, for example, a high pressure diaphragm pump.

Flowable explosive is discharged from the explosive tank 1 via the selector valves 8, 11 to the delivery hose 23 by applying fluid pressure to the piston 6 via the pressure inlet manifold 5. The fluid pressure is, for example, air pressure from a source of compressed air, for example, a truck compressed air system. The air pressure displaces the piston 6 forwardly toward the explosive end of the explosive tank 1. The forward displacement of the piston 6 is monitored by the piston displacement sensor 4. The discharge pressure of flowable explosive is indicated by a pressure meter 13. The delivery hose 23 is unwound from the hose reel 22 and positioned to deliver the flowable explosive from the explosive tank 1 to a surface or underground delivery site, for example, a blast hole. The delivery rate of the flowable explosive is, for example, up to around 1100 litres per minute. The flowable explosive is substantially fully discharged from the explosive tank 1 by the piston 6 as the "self-cleaning" action of the piston 6 and the piston seals 7 leaves less than around 0.05% by weight of the initial load of flowable explosive remaining in front of the piston 6.

The pressure required to discharge flowable explosive is selectively reduced by injecting flowable lubricant stored in the lubricant tank 16 into the delivery hose 23. The lubricant is, for example, water, oil, polymeric lubricant, etc. The flowable lubricant is pumped from the lubricant tank 16 via selector valve 17 by the additive pump 14 to an injector 19 fitted to the delivery hose 23. The pressure and flow rate of lubricant injected into the delivery hose 23 are respectively indicated by a flow meter 20 and a pressure meter 21. The additive pump 14 is, for example, a piston pump. The lubricant tank 16 is filled with flowable lubricant via a filler or from an external source (not shown) via the selector valves 9, 18. Lubricant, such as water, is selectively pumped by the additive pump 14 from the lubricant tank 16 through the explosive pump 10 for cleaning the explosive pump 10, injector 19 and delivery hose 23 after flowable explosive has been discharged from the explosive tank 1. A check valve between the lubricant tank 16 and the selector valve 18 prevents backup of water into the lubricant tank 16 during cleaning.

Explosive additive stored in the explosive additive tank 15 is selectively injectable into the delivery hose 23 by the additive pump 14 via the selector valve 17. The explosive additive is, for example, gassing solution. The explosive additive tank 15 is filled with explosive additive via a filler. The flow and pressure meters 20, 21 measure the flow and pressure of explosive additive injected into the delivery hose 23.

Referring to FIG. 2, a control panel 25 is provided at one end of the platform 24 for the flow and pressure meters 12, 13, 20, 21, a display of the piston displacement sensor 4, and controls for the explosive pump 10 and the additive pump 14. The selector valves can be solenoid valves having controls provided in the control panel 25.

The mobile delivery platform 26 can form part of a mobile manufacturing unit (MMU), an underground delivery system, or a plant storage unit.

It will be appreciated that embodiments of the invention advantageously provide a mobile, self-cleaning delivery platform for flowable explosive.

The embodiments have been described by way of example only and modifications are possible within the scope of the claims which follow.

The invention claimed is:

1. Apparatus for storing and dispensing flowable explosive, the apparatus including an explosive pump for pumping flowable explosive into an explosive tank having a fluid pressure-actuated piston movable therein for expelling flowable explosive out of the explosive tank through a delivery hose fitted with an injector through which one or more additives from one or more additive tanks can be pumped by an additive pump.

2. Apparatus according to claim 1, wherein the explosive tank and the piston therein are cylindrical with a common horizontal longitudinal axis.

3. Apparatus according to claim 2, wherein the piston has one or more circumferential seals for cleaningly wiping the inner surface of the explosive tank.

4. Apparatus according to claim 2, wherein the piston is a concave piston that is radially expandable to sealingly engage the inner surface of the explosive tank.

5. Apparatus according to claim 1, wherein the explosive tank has a detector therein for detecting displacement of the piston and/or monitoring quantities of flowable explosive in the explosive tank.

6. Apparatus according to claim 1, wherein the one or more additives are lubricant stored in a lubricant tank, and explosive additive stored in an explosive additive tank.

7. Apparatus according to claim 1, wherein the delivery hose is wound on a hose reel.

8. Apparatus according to claim 1, wherein the tanks, pumps, and hose reel are arranged on a transportable platform.

9. Apparatus according to claim 1, wherein the flowable explosive is selected from emulsion explosive, gel explosive, slurry explosive, blended explosive, and doped explosive.

10. A method of delivering flowable explosive using apparatus according to any preceding claim.

* * * * *